US006749352B2

(12) United States Patent
Yamada et al.

(10) Patent No.: US 6,749,352 B2
(45) **Date of Patent: *Jun. 15, 2004**

(54) CUTTING APPARATUS AND PRINTERS PROVIDED WITH CUTTING APPARATUS

(75) Inventors: Koji Yamada, Nagano (JP); Toru Takami, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/409,028

(22) Filed: Sep. 29, 1999

(65) Prior Publication Data

US 2002/0006302 A1 Jan. 17, 2002

(30) Foreign Application Priority Data

Sep. 29, 1998 (JP) ..... 10-276212

(51) Int. Cl.[7] ..... B41J 11/66

(52) U.S. Cl. ..... 400/593; 400/621; 101/93.07; 101/226; 83/563; 83/564; 83/568

(58) Field of Search ..... 400/593, 621; 101/226, 224, 227, 93.07; 83/564, 563, 602, 568

(56) References Cited

U.S. PATENT DOCUMENTS

| | | | | |
|---|---|---|---|---|
| 4,620,467 | A | | 11/1986 | Margraf et al. |
| 5,431,077 | A | | 7/1995 | Murakami |
| 5,833,380 | A | | 11/1998 | Hosomi et al. |
| 5,839,840 | A | | 11/1998 | Kawano |
| 5,915,644 | A | * | 6/1999 | Prittie ..... 242/525.4 |
| 6,155,731 | A | * | 12/2000 | Bertalan et al. ..... 400/621 |
| 6,361,231 | B1 | * | 3/2002 | Sato et al. ..... 400/120.16 |
| 6,447,187 | B1 | * | 9/2002 | Robinson ..... 400/621 |

FOREIGN PATENT DOCUMENTS

| | | | |
|---|---|---|---|
| CN | 1159393 A | | 9/1997 |
| EP | 0 775 585 | | 5/1997 |
| JP | 54-123482 | | 2/1978 |
| JP | 58-120498 | | 7/1983 |
| JP | 60-16400 | | 1/1985 |
| JP | 60-122747 | | 8/1985 |
| JP | 3-3870 | | 1/1991 |
| JP | 06-016321 | | 1/1994 |
| JP | 06-063890 | | 3/1994 |
| JP | 6-134692 | | 5/1994 |
| JP | 6-226684 | | 8/1994 |
| JP | 07-164695 | | 6/1995 |
| JP | 7-290780 | | 11/1995 |
| JP | 9-141595 | | 6/1997 |
| JP | 10-592 | | 1/1998 |
| JP | 10-100493 | | 4/1998 |
| JP | 10-100494 | | 4/1998 |
| JP | 10-156789 | | 6/1998 |
| JP | 2000-272200 | * | 3/2000 |

OTHER PUBLICATIONS

Patent Abstracts of Japan, vol. 17, No. 574 (M–1498), Oct. 19, 1993 & JP 05 169398 A.

* cited by examiner

*Primary Examiner*—Charles H. Nolan, Jr.
*Assistant Examiner*—Kevin D. Williams
(74) *Attorney, Agent, or Firm*—Nixon Vanderhye P.C.

(57) ABSTRACT

A printer includes a cutting apparatus with a shield that protects the cutting part of a cutter blade in the apparatus. A fixed blade is supported so that the fixed blade can be moved by pressure by a compression coil spring upon a fixed blade supporting frame attached to a body frame so that the fixed blade supporting frame can be opened or closed. A blade cover for protecting the cutting part of the fixed blade is fixed to the fixed blade supporting frame. When each fitting between fitting parts of the fixed blade and touching parts of a cutter frame is released in a state in which the fixed blade supporting frame is open, a part or the whole of the cutting part of the fixed blade is shielded by the shielding part of the blade cover.

20 Claims, 6 Drawing Sheets

CUTTING APPARATUS AND PRINTERS PROVIDED WITH CUTTING APPARATUS

BACKGROUND OF INVENTION

1. Field of Invention

The present invention relates to a cutting apparatus for cutting recording paper and a printer provided with the cutting apparatus, and in particular relates to a cutting apparatus provided with a mechanism for protecting the blade of the cutting apparatus and a printer provided with the cutting apparatus.

2. Related Art

Generally, a printer applied to an electronic cash register used in point of sales (POS) is provided with a cutting apparatus for cutting recording paper to issue as a receipt after rolled recording paper is printed by a print head according to methods such as a thermosensible method.

The type of cutting apparatus described above is called a "scissors-type" cutting apparatus which comprises a movable blade and a fixed blade respectively arranged on opposite sides of a transport path of the recording paper. The movable blade is moved in a direction perpendicular to recording paper and the recording paper is cut from one end to the other end. This type of cutting apparatus is disclosed in Japanese published unexamined utility model No. Hei2-10953.

A cutting apparatus includes a movable blade that is arranged on the side of the body of a printer and a fixed blade arranged on a cover supported by the body of the printer so that the cover can be opened or closed. The recording paper is cut by sliding the movable blade on the fixed blade in a known state in which the cover is closed.

Another type of cutting apparatus is disclosed in Japanese published unexamined patent application No. Sho60-16400. In this reference the cutting apparatus is provided on a cover. The cutter includes a shielding member for shielding a cutter blade along with the movement of the cover. The shielding member shields the cutter blade when the cover is opened, and when the cover is closed, the cutter blade is exposed. When the cover is opened and closed to replace rolled paper, damage to the exposed blade is prevented.

However, in a conventional type cutting apparatus, a mechanism such as a cam is required to move between a position in which the cutting part of the cutter blade is shielded by the shielding member and a position in which the cutting part is exposed as the cover is opened or closed. This type of configuration can be complicated. In addition, as the shielding member is gradually moved from the exposed position to the shielded position as the cover is opened, unless the cover is completely open, the cutter blade cannot be shielded and protected.

SUMMARY OF INVENTION

The present invention provides a cutting apparatus wherein a cutter blade can be securely protected with a simple configuration. In addition, a printer provided with the cutting apparatus is provided.

In one aspect, a cutting apparatus is provided with first and second cutter blades arranged on opposite sides of the transport path of recording paper, first supporting structure for supporting the first cutter blade and second supporting structure, which can be moved with respect to the first supporting structure, for supporting the second cutter blade. The second cutter blade is supported so that it can be moved to a first position in which recording paper can be cut in cooperation with the first cutter blade and a second position in which recording paper cannot be cut without incorporating with the first cutter blade depending upon the position of the second supporting structure. The second supporting structure is provided with a first projection protruded on the side of the second cutter blade from the surface contact with the second cutter blade in the second position and located on the side of the transport path of the second cutter blade.

When the second supporting structure is arranged in a position in which the first and second cutter blades are not in cooperation, the second cutter blade is moved and a part or the whole of its cutting part is shielded by the first projection. The cutting part of the second cutter blade can be protected without causing chipping and the like in the cutting part of the second cutter blade.

In an implementation, when the second supporting structure is provided with an elastic body and the second cutter blade is located in the second position, it is desirable that the second cutter blade is pressed against the contact surface of the second supporting structure by the elastic force of the elastic body and a part or the whole of the second cutter blade is shielded by the first projection. It is also desirable that the first supporting structure is provided with a touching part for coming in contact with the second cutter blade and moving the second cutter blade to the first position against the elastic force of the elastic body.

As the cutting part of the second cutter blade is automatically shielded by the first projection in case the second supporting structure is moved and the first and second cutter blades are not in cooperation, the cutting part of the cutter blade can be securely protected.

As the cutting part of the second cutter blade is automatically exposed from the first projection in case the second supporting structure is moved and the first and second cutter blades are in cooperation, special operation for putting the cutter blade in a state in which it can cut recording paper is not required and a cutter that is easy to handle can be acquired.

The cutter blade can be shielded or exposed with a simple configuration without requiring a complicated mechanism such as a cam mechanism by utilizing the elastic force of the elastic body.

In an implementation, the first projection is fixed to the second supporting structure.

As the projection is not moved even if the second supporting structure is arranged in a position in which the first and second cutter blades are not in cooperation and external force is applied to the first projection, the second cutter blade can be more securely protected.

In an implementation, a guide part for guiding the carriage of recording paper is provided and the guide part is integrated with the shielding part.

The leading end of recording paper can be securely guided to the cutter blade along the guide part. As the guide part for guiding recording paper is moved together with the second supporting structure and the transport path of recording paper is free in case the second supporting structure is moved and the first and second cutter blades are put in a state in which they are not in cooperation, work such as replacing rolled paper can be easily performed.

In an implementation, the second supporting structure is provided with a second projection on the side opposite to the surface contact with the second cutter blade of the second supporting structure with the second cutter blade between.

The second cutter blade can be more securely protected in cooperation with the first projection.

In an implementation, the first cutter blade is a movable blade and the second cutter blade is a fixed blade. The cutting apparatus is a so-called scissors-type cutting apparatus wherein the first cutter blade is in contact with the second cutter blade at a point to subject the scissors-like sliding action.

Since a mechanism for driving the movable blade is not required to be provided to the turned second supporting structure, the configuration is simplified.

In another aspect, a printer provided with a cutting apparatus which can securely protect the cutting part of the fixed blade is also acquired. The printer is provided with a main frame including a print unit for printing on recording paper and a cover frame supported by the main frame so that the cover frame can be opened or closed. The main frame includes the first supporting structure, the cover frame includes the second supporting structure and the cover frame is pivotally supported so that the cover frame can be turned between a closed position equivalent to the first position and an open position equivalent to the second position.

Other features and advantages will be readily apparent from the following description, the accompanying drawings, and the claims.

DETAILED DESCRIPTION OF PREFERRED EMBODIMENTS

Figure 1:
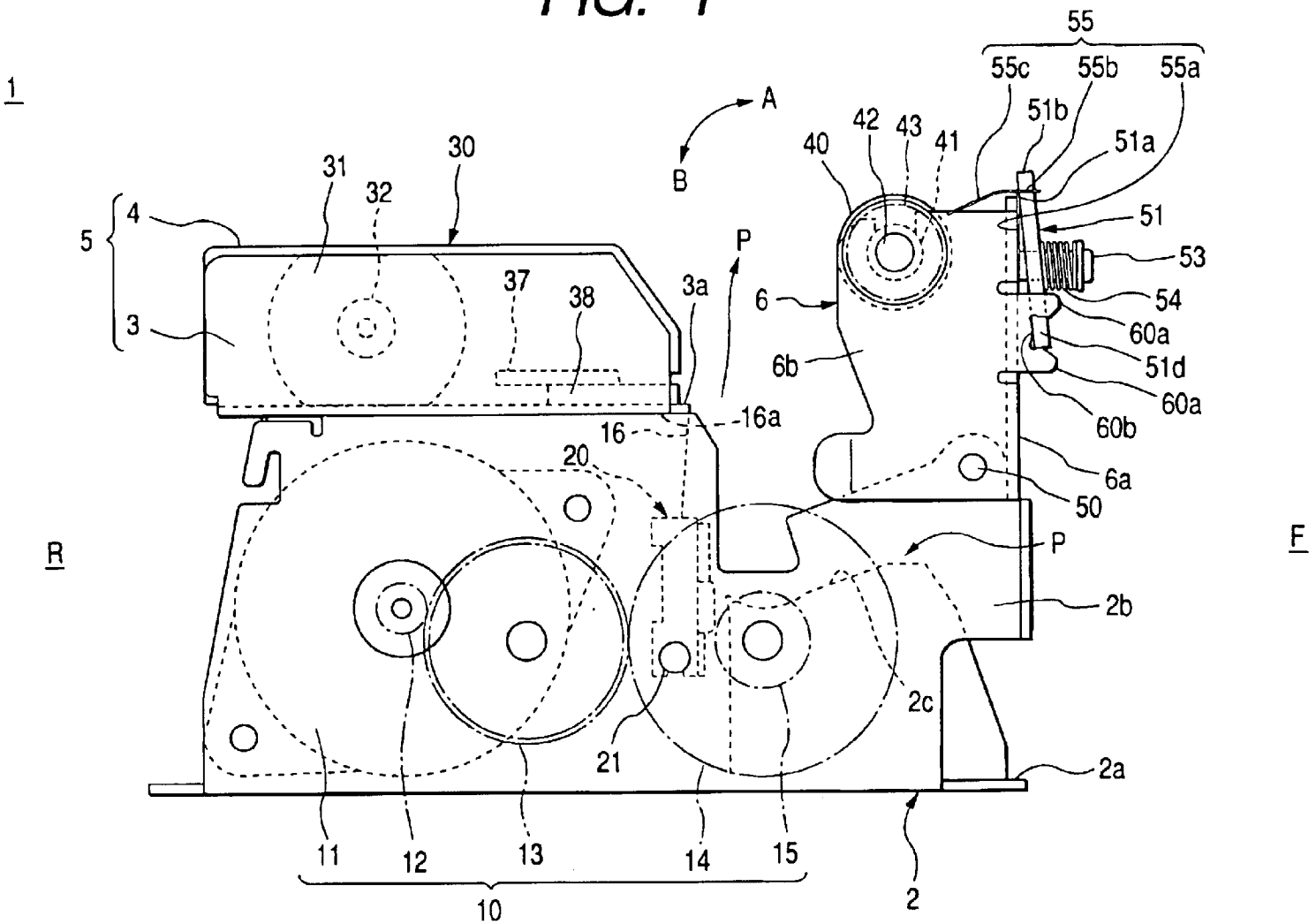
FIG. 1 is a front view showing the main part of the internal configuration of a printer in which a cover frame is open.

Referring to the drawings, an embodiment of a printer according to the present invention will be described in detail below.

A printer described in this embodiment is provided with a scissors-type cutting apparatus that includes a fixed blade and a movable blade as described later.

Figure 2:
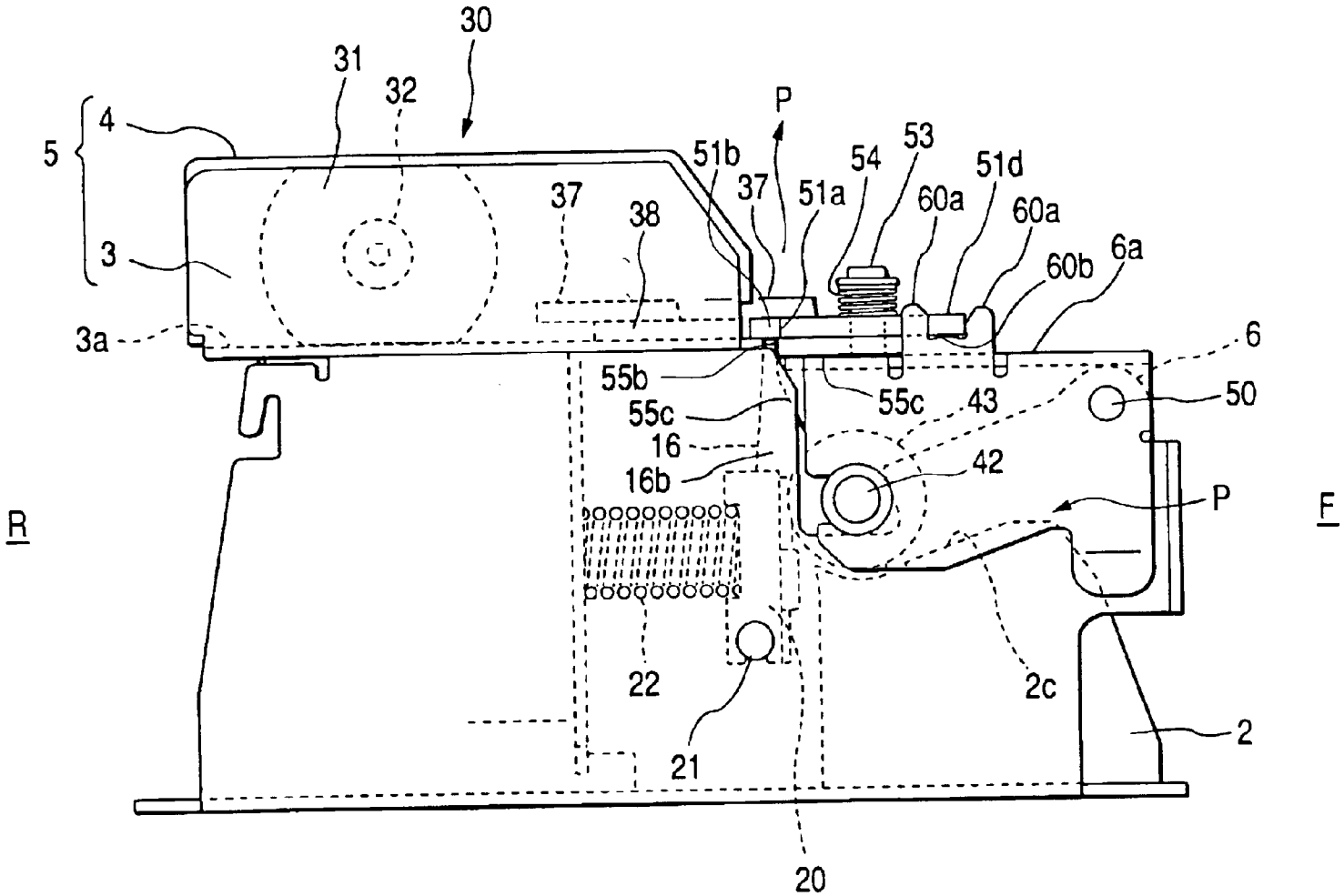
FIG. 2 is a front view of the printer of FIG. 1 in which the cover frame is closed.

FIGS. 1 and 2 are front views showing the main part of the internal configuration of the printer according to the present invention and showing a state in which a cover frame is open and a state in which it is closed, respectively.

As shown in FIG. 1 or 2, a printer 1 is provided with a body frame 2 and a fixed blade supporting frame 6 (second supporting structure, hereinafter also called a cover frame) which is pivotally supported on the body frame 2.

The body frame 2 includes a bottom 2*a* and a side 2*b* formed at both ends of the bottom 2*a*. The fixed blade supporting frame 6 located in the upper part on the front side (the side of F in the drawings) of both sides 2*b* of the body frame 2 for supporting a fixed blade 51 (a second cutter blade) is pivotally supported by a spindle 50 in a direction shown by an arrow A and B so that the fixed blade supporting frame 6 can be opened or closed with respect to the main body 2.

The fixed blade supporting frame 6 comprises a flat supporting structure 6*a* and a side 6*b* formed at both ends of the supporting structure 6*a*. Both sides 6*b* are supported by the body frame 2 in a state in which both sides are respectively overlapped with both sides 2*b* of the body frame 2. In an embodiment, the body frame 2 and the fixed blade supporting frame 6 are formed by folding sheet metal.

A cutter unit 30 in which a movable blade 37 (a first cutter blade) is housed is mounted on the upper part on the rear side (the side of R in the drawings) of both sides 2*b* of the body frame 2. The cutter unit 30 is provided with a cutter case 5 (first supporting structure) comprising a cutter frame 3 and a cutter cover 4. The movable blade 37 and a cutter motor 31 for driving the movable blade 37 are arranged in the cutter case 5.

A thermal head 20 is provided inside both sides 2*b* of the body frame 2 with a spindle 21 in the center so that the thermal head can be turned. The thermal head 20 is connected to a circuit board (not shown) via a cable and as shown in FIG. 2, is pressed on a platen roller 40 (as described below) by a head pressing spring 22.

The platen roller 40 is attached to the fixed blade supporting frame 6 and is arranged so that the platen roller is opposite to the thermal head 20 in a state in which the fixed blade supporting frame 6 is closed. The platen roller 40 is supported so that it can be turned by making a bearing 41 attached to the fixed blade supporting frame 6 support a platen shaft 42. Recording paper passes between the thermal head 20 and the platen roller 40 and is printed by the thermal head 20.

A driver unit 10 for rotating the platen roller 40 is provided inside both sides 2*b* of the body frame 2 as shown in FIG. 1. The driver unit 10 comprises a driving motor 11 provided on the rear side (the side of R) of the body frame 2 and a gear train for transmitting the torque of the driving motor 11 via a motor gear 12 to an intermediate gear 14 via a reduction gear 13. The platen roller 40 is rotated by making a platen gear 43 fixed to one end of the platen shaft 42 engaged with a gear 15 coaxial and integrated with the intermediate gear 14 in a state in which the fixed blade supporting frame 6 is closed. Recording paper is carried along a transport path P (described below) as the platen roller 40 is rotated.

A printing guide 2*c* for guiding recording paper pulled out from roll paper (not shown) toward between the thermal head 20 and the platen roller 40 is provided on the front side (the side of F) of the body frame 2. A cutter guide 16 is attached to the back of the bottom 3*a* of the cutter frame 3. The cutter guide 16 comprises a mounting part 16*a* overlapped with the back of the bottom 3*a* of the cutter frame 3 and a guide part 16*b* bent in a direction approximately perpendicular to the mounting part 16*a*. In an embodiment, the cutter guide 16 is formed by bending a stainless steel sheet. The cutter guide 16 is arranged so that its guide part 16*b* is directed to the thermal head 20. Recording paper is guided from the front side (the side of F in the drawings) of the body frame 2 to a printing guide part 2*c*. The recording paper then passes between the thermal head 20 and the platen roller 40, between the guide part 16*b* of the cutter guide 16 and a blade cover 55 (as described below), and between the fixed blade 51 and the movable blade 37. Finally, the recording paper is carried outside the printer 1 (the transport path P).

Figure 3:
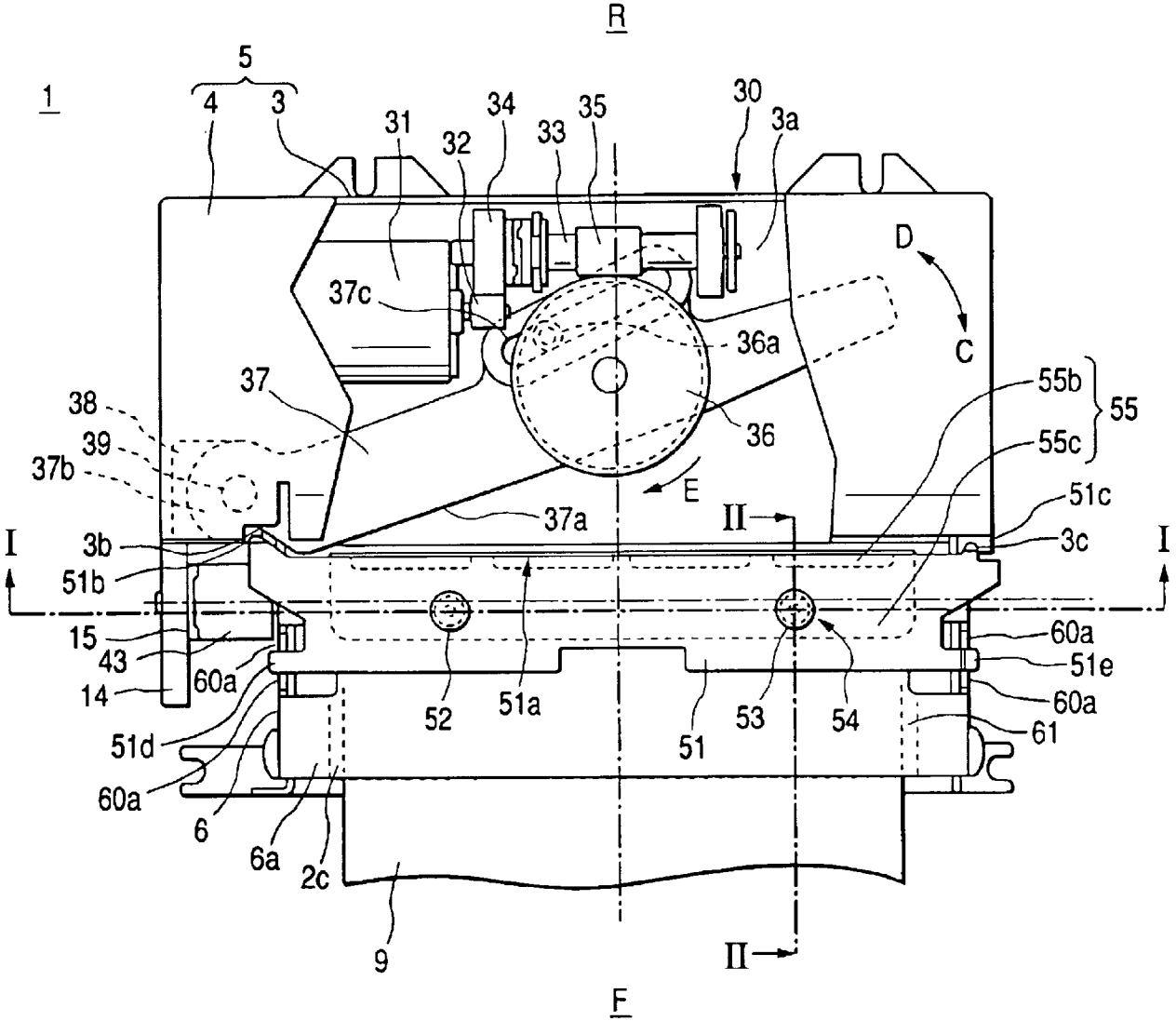
FIG. 3 is a cut away view of the main part of the internal configuration of the printer of FIG. 1.

Referring to FIG. 3, the cutter unit 30 is described. FIG. 3 is a plan view of the main part of the internal configuration of the printer of the present invention. The movable blade 37 comprises a substantially rectangular plate member, a cutting part 37*a* formed at one edge in the longitudinal direction and a long hole 37*c* formed in the approximately center at the other end. In an embodiment, the movable blade is metallic. The movable blade 37 is supported at the end 37*b* on the side from which cutting is started. The movable blade can be turned with a spindle 39 provided on the front side (side F in FIG. 3) of the bottom 3*a* of the cutter frame 3 in the center in a direction shown by an arrow C or D.

A spacer 38 is provided between the end 37*b* of the movable blade 37 and the bottom 3*a* of the cutter frame 3 to secure a predetermined quantity of clearance between the movable blade 37 and the bottom 3*a* of the cutter frame 3 (see FIG. 1 or 2).

The cutter motor 31 is arranged in the rear part of the cutter frame 3 and on the side of spindle 39 to avoid preventing the movable blade 37 from being turned. The torque of the cutter motor 31 is transmitted to a gear 32 fixed to the rotating shaft of the cutter motor 31, a gear 34 engaged with the gear 32, a driving shaft 33 rotated together with the gear 34 and a worm wheel 36 engaged with a worm 35 with the worm 35 fixed to the driving shaft 33. The worm wheel 36 is rotated in a predetermined direction (for example, a direction shown by an arrow E in FIG. 3).

A crank pin 36*a* protrudes from the back (the side of the bottom 3*a* of the cutter frame 3) of the worm wheel 36 so that the crank pin 36*a* fits into the long hole 37*c* of the movable blade 37. Thus, the movable blade 37 is turned in the direction shown by the arrow C or D with the spindle 39 in the center of a turn. Recording paper 9 is cut by turning the movable blade 37 in the direction shown by the arrow C, and the movable blade 37 can be positioned in a standby position by turning the movable blade 37 in the direction shown by the arrow D.

Figure 4:
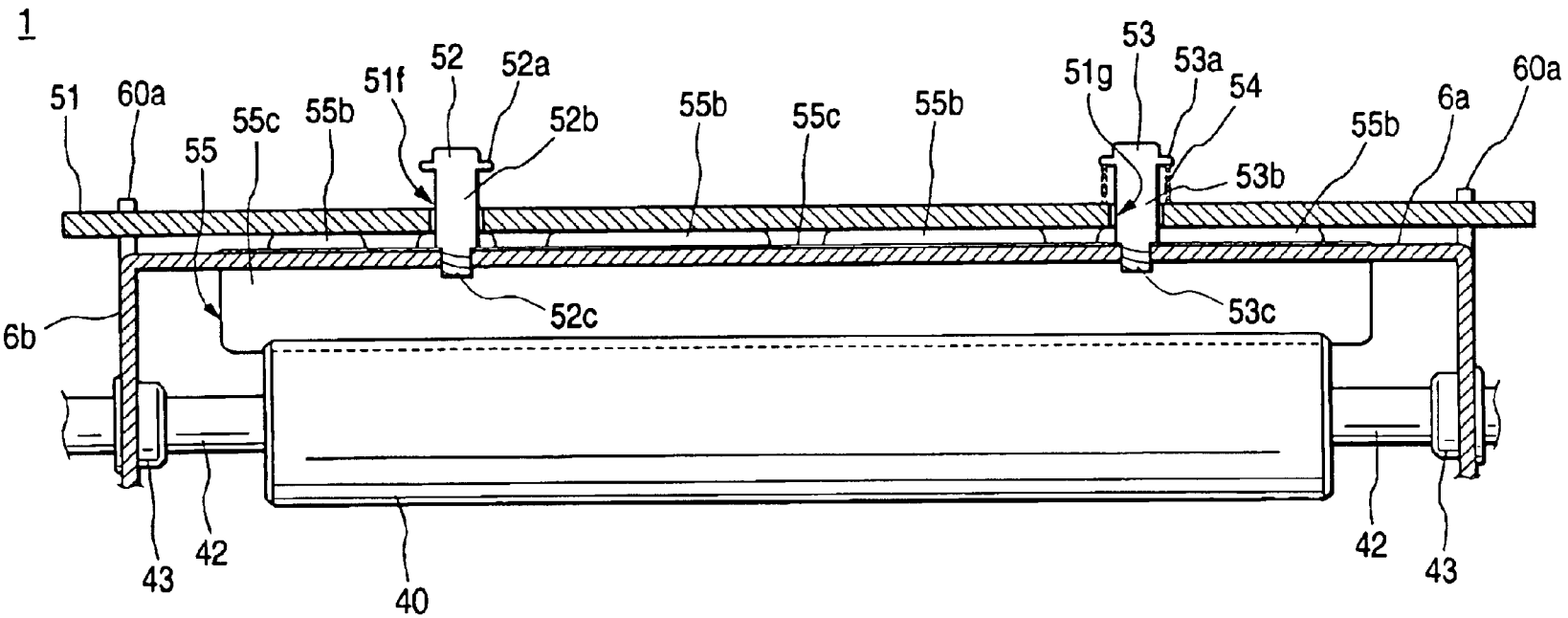
FIG. 4 is a sectional view along a line I—I in FIG. 3.
Figure 5:
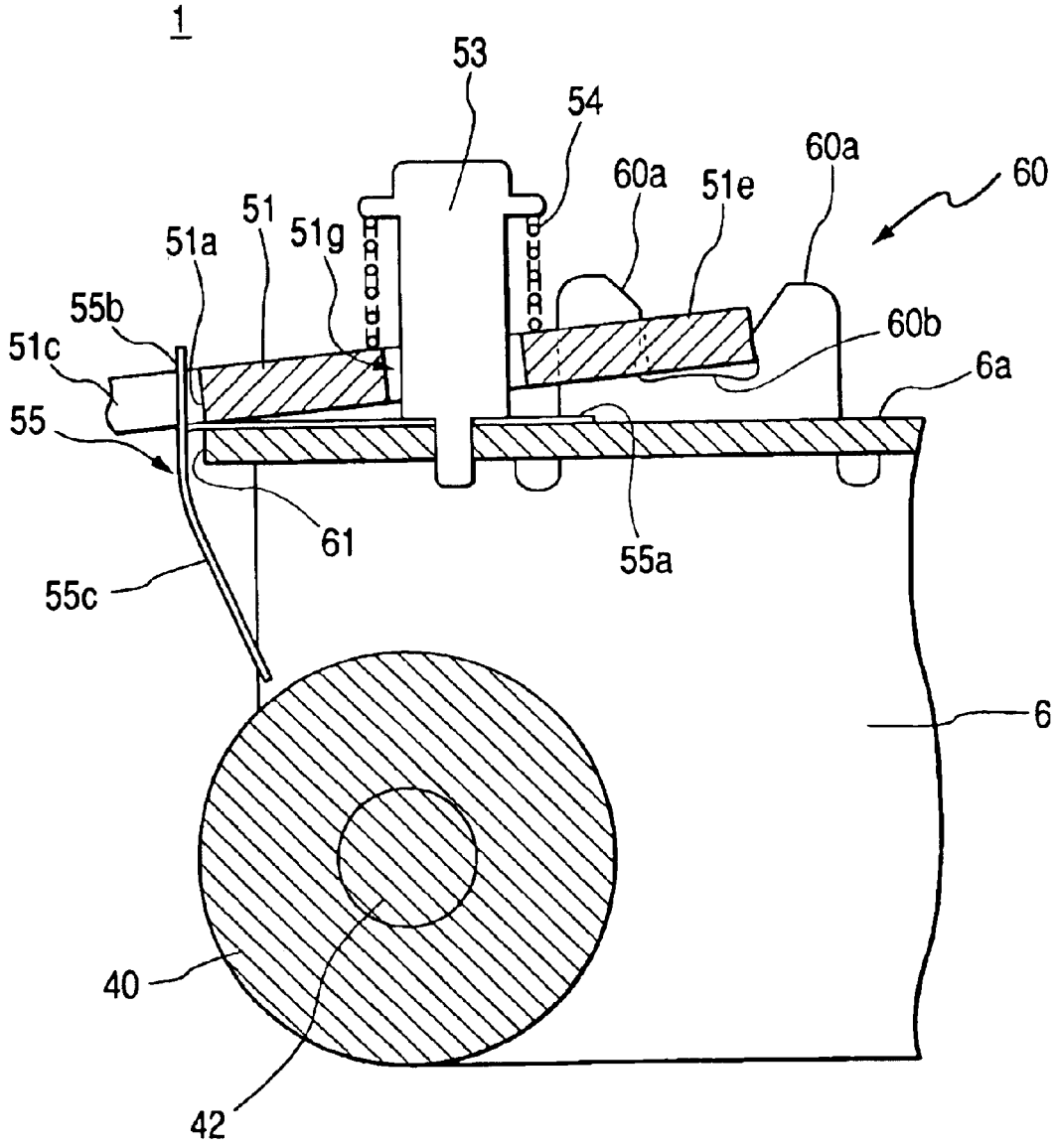
FIG. 5 is a sectional view along a line II—II in FIG. 3.

Referring to FIGS. 3, 4 and 5, the fixed blade supporting frame 6 is described. FIG. 4 is a sectional view viewed along a line I—I in FIG. 3 and FIG. 5 is a sectional view viewed along a line II—II in FIG. 3. As shown in the drawings, the fixed blade 51 for cutting recording paper 9 in cooperation with the above movable blade 37 is arranged over the supporting structure 6*a* of the fixed blade supporting frame 6. The fixed blade 51 comprises a metallic approximately rectangular plate member, and its cutting part 51*a* is formed at one edge in the longitudinal direction. Two fitting projections 51*b* and 51*c* are formed at both ends of the cutting part 51*a* so that they are protruded in a direction approximately perpendicular to the longitudinal direction of the fixed blade 51. The cutting part 51*a* of the fixed blade 51 is arranged along the rear edge of the supporting structure 6*a* of the fixed blade supporting frame 6. The fitting projections 51*b* and 51*c* protrude from the rear edge of the supporting structure 6*a* toward the cutter frame 3. Supporting projections 51*d* and 51*e* are formed at both ends of the other end in the longitudinal direction of the fixed blade 51 so that the supporting projections protrude in the longitudinal direction of the fixed blade 51. Holes 51*f* and 51*g* for piercing supporting shafts 52 and 53 (as described below) are provided at a predetermined interval in the fixed blade 51.

A positioning support 60 approximately in the shape of U for positioning and supporting the fixed blade 51 protrudes from the edge on both sides of the supporting structure 6*a* of the fixed blade supporting frame 6. The positioning support 60 comprises a pair of positioning parts 60*a* provided at a predetermined interval and a supporting bottom 60*b* formed between the positioning parts 60*a*. The supporting bottom 60*b* is provided in a position spaced a predetermined distance from the surface of the supporting structure 6*a* as shown in FIG. 5. The supporting projections 51*d* and 51*e* of the fixed blade 51 are fitted to the positioning support 60. An interval between the positioning parts 60*a* is formed so that it is slightly wider than the width of each supporting projection 51*d* or 51*e*. Thus, the fixed blade 51 is supported with slight clearance by the positioning support 60.

The two supporting shafts 52 and 53 supporting the fixed blade 51 are arranged at a predetermined interval in the supporting structure 6*a* of the fixed blade supporting frame 6 in such a manner that the fixed blade 51 moves with respect to the fixed blade supporting frame 6. These supporting shafts 52 and 53 respectively pierce the holes 51*f* and 51*g* provided to the fixed blade 51 and are attached to the supporting structure 6*a* of the fixed blade supporting frame 6.

As shown in FIG. 4, a headed screw is used for the supporting shafts 52 and 53. The supporting shaft 52 comprises a head 52*a*, a shank 52*b* having a smaller diameter than the diameter of the head 52*a* and a threaded portion 52*c* having a smaller diameter than the diameter of the shank 52*b*. The supporting shaft 53 similarly comprises a head 53*a*, a shank 53*b* having a smaller diameter than the diameter of the head 53*a* and a threaded portion 53*c* having a smaller diameter than the diameter of the shank 53*b*.

The holes 51*f* and 51*g* provided in the fixed blade 51 are formed so that each inner diameter is larger than the outer diameter of the shank 52*b* or 53*b* of each supporting shaft 52 or 53. The outer diameter of the head 52*a* or 53*a* of each supporting shaft 52 or 53 is formed so that it is larger than the inner diameter of each hole 51*f* or 51*g*.

An elastic structure 54 is inserted between the head 53*a* of one supporting shaft 53 and the fixed blade 51, and the fixed blade 51 is pressed on the supporting structure 6*a* of the fixed blade supporting frame 6 by the elastic force of the elastic structure 54. In an embodiment, the elastic structure 54 is a compression coil spring.

In such a configuration, the fixed blade 51 could be moved around an axis defined by the supporting projections 51*d* and 51*e* on the supporting structure 6*a* against the elastic force of the elastic structure 54.

As shown in FIG. 5, a blade cover 55 is attached to the fixed blade supporting frame 6. The blade cover 55 comprises a flat mounting part 55*a*, plural rectangular shielding parts 55*b* (first projections) approximately perpendicular to the mounting part 55*a*, and a guide part 55*c* extended on the same plane as the shielding part 55*b* and bent on the side of the mounting part 55*a* from its halfway part to the end. In an embodiment, the blade cover 55 is formed by slitting and bending a stainless steel sheet in a predetermined pattern. In an implementation, the blade cover 55 is formed so that the height of the shielding part 55*b* is equal to or higher than the thickness of the fixed blade 51.

The mounting part 55*a* of the blade cover 55 is arranged so that it is overlapped with the supporting structure 6*a* of the fixed blade supporting frame 6, is screwed by the supporting shafts 52 and 53 and is fixed to the fixed blade supporting frame 6. The shielding part 55*b* of the blade cover 55 is slightly protruded from the rear edge 61 of the supporting structure 6*a* of the fixed blade supporting frame 6. The end of the guide part 55*c* of the blade cover 55 is directed to the platen roller 40.

The operation of the movable blade 37 and the fixed blade 51 is described. As shown in FIG. 3, in a state in which the fixed blade supporting frame 6 is closed, the fixed blade 51 and the movable blade 37 are arranged so that the respective cutting parts 51*a* and 37*a* are facing each other with the transport path P between them.

Touching parts 3*b* and 3*c* for respectively fitting to the fitting projections 51*b* and 51*c* of the fixed blade 51 are formed at both ends of the front edge of the bottom 3*a* of the cutter frame 3 in which the movable blade 37 is arranged. The touching part 3*c* is formed in a part on the side on which cutting is finished of the bottom 3*a* of the cutter frame 3 so that the touching part is slightly protruded toward the fixed blade supporting frame 6. The touching parts 3*b* and 3*c* are arranged so that each touching part and the lower surface of the movable blade 37 meet according to a predetermined positional relationship, and the fixed blade 51 is positioned in a position suitable for the movable blade 37 in a state in which its fitting projections 51*b* and 51*c* are respectively in contact with the touching parts 3*b* and 3*c*.

In a state in which the fixed blade supporting frame 6 is closed, the fitting projection 51*b* of the fixed blade 51 is overlapped with the touching part 3*b* of the cutter frame 3 from the upper side, and the fitting projection 51*c* of the fixed blade 51 is overlapped with the touching part 3*c* of the cutter frame 3 from the upper side.

When the fitting projections 51*b* and 51*c* of the fixed blade 51 are respectively fitted to the touching parts 3*b* and 3*c* of the cutter frame 3 as shown in FIG. 2 or 3 when the fixed blade supporting frame 6 is closed, the fixed blade 51 is lifted from the supporting structure 6*a* of the fixed blade supporting frame 6 against the elastic force of the elastic structure 54. As a result, the cutting part 51*a* of the fixed blade 51 is exposed from the shielding part 55*b* of the blade cover 55, and the movable blade 37 can cross the fixed blade 51 and can be slid on the fixed blade. The movable blade 37 moves in the direction shown by the arrow C by operating the cutter motor 31 and recording paper 9 is cut.

As each fitting between the fitting projections 51*b* and 51*c* of the fixed blade 51 and the touching parts 3*b* and 3*c* of the cutter frame 3 is released as shown in FIG. 1 or 5, if the fixed blade supporting frame 6 is open, the fixed blade 51 is pressed on the supporting structure 6*a* of the fixed blade supporting frame 6 by the elastic force of the elastic structure 54. As a result, the cutting part 51*a* of the fixed blade 51 is shielded in the shielding part 55*b* of the blade cover 55.

In an alternate embodiment, the height of a shielding part 55*b* of a blade cover 55 and in that a paper guide 70 is provided and the description of a part common to the first embodiment is omitted.

Figure 6:
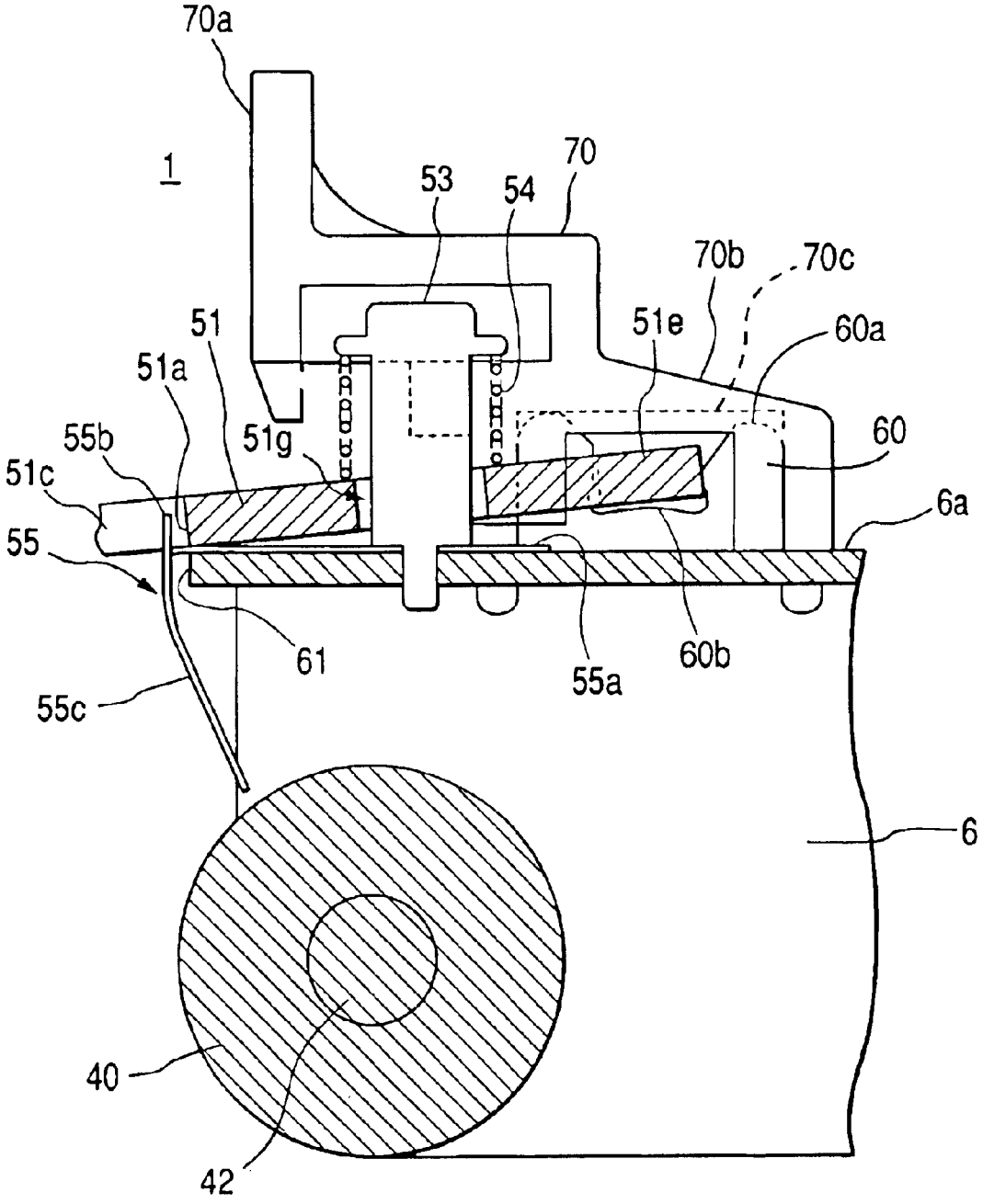
FIG. 6 is a sectional view of an alternate embodiment.

FIG. 6 is a sectional view equivalent to FIG. 5 and shows a state in which a fixed blade supporting frame 6 is open and a fixed blade 51 is pressed on supporting structure 6*a* of the fixed blade supporting frame 6 by the elastic force of an elastic structure 54.

In the alternate embodiment, as shown in FIG. 6, the shielding part 55*b* of the blade cover 55 is formed so that a part of the cutting part 51*a* of the fixed blade 51 is covered.

Namely, the height of the shielding part 55*b* of the blade cover 55 is shorter than the thickness of the fixed blade 51. The reason is that in the case the fixed blade 51 and the movable blade 37 cooperate therewith to cut the recording medium while the fixed blade supporting frame is closed, when the shield part 55*b* has a thickness which is close to the slidable surface defined between the fixed blade 51 and the movable blade 37, the angle defined between the recording paper and the fixed blade 51 or the movable blade 37 becomes narrow, that is, the recording paper is inclined toward the movable blade side upstream of the transport direction and toward the fixed blade side downstream of the transport direction. This phenomenon increases the possibility of cutting failure. As mentioned above, the height of the shielding part 55*b* is determined in consideration for the movement quantity of the fixed blade 51 along with open/close operation of the fixed blade supporting frame 6.

As the cutting part 51*a* of the fixed blade 51 approaches the shielding part 55*b* of the blade cover 55 when the fixed blade supporting frame is opened, the probability of problems such as damage to the cutting part 51*a* is reduced.

In consideration for the usual operation circumstance and the shape of the cutting part 51*a* of the fixed blade 51, it becomes apparent by experiment that the height of the shielding part 55*b* is approximately more than ½ of the thickness of fixed blade 51.

Further, a printer 1 in this embodiment is provided with a paper guide 70 for guiding the recording paper 9 after cutting outside the printer. The paper guide 70 is provided with a guide part 70*a* for guiding recording paper, a pressing part 70*b* for closing the fixed blade supporting frame 6 and an attachment part 70*c* for attaching to the fixed blade supporting frame 6. The attachment part 70*c* is fitted to a positioning support 60 of the fixed blade supporting frame 6 and is screwed to the fixed blade supporting frame 6 approximately in the center of the pressing part 70*b*. In an embodiment, the paper guide 70 can be formed by molding resin.

The guide part 70*a* (a second projection) has a rectangular plane approximately parallel to the shielding part 55*b* of the blade cover 55 and protects the cutting part 51*a* of the fixed blade 51 in cooperation with the shielding part 55*b* of the blade cover 55. The guide part 70*a* is also used to guide paper. The probability in which foreign matter comes in contact with the cutting part 51*a* can be reduced by the plane of the guide part 70*a* and the plane of the shielding part 55*b*. Even if foreign matter comes in contact with the cutting part 51*a*, pressure applied to the cutting part 51*a* can be reduced.

As described above, according to the present invention, as the fixed blade 51 is immediately moved and a part or the whole of the cutting part 51*a* is automatically shielded by the shielding part 55*b* of the blade cover 55 when the fixed blade supporting frame 6 is opened, the cutting part 51*a* can be securely protected and the cutting part 51*a* can be protected from chipping. Maintenance work and other types of access can be safely performed. As contact pressure between the cutting part 51*a* and the user's finger can be reduced even if a user accidentally touches a cutter blade, the user can avoid an injury of cutting a finger or the like.

As the cutting part 51*a* of the fixed blade 51 is automatically exposed from the shielding part 55*b* when the fixed blade supporting frame 6 is closed, the cutting part is able to immediately cut recording paper, and a cutter that is easy to handle and a printer provided with the cutter can be obtained.

Use of the fixed blade 51 pressed by the elastic force of the elastic structure 54 and the cutting part 51*a* shielded by the shielding part 55*b*, avoids use of a complicated mechanism such as a cam mechanism, and a cutting apparatus of the cutting part 51*a* of which can be shielded and a printer provided with the cutter can be obtained with simple configuration.

As the blade cover 55 is fixed to the fixed blade supporting frame 6 and the shielding part 55*b* is not moved even if external force is applied to the shielding part 55*b* of the blade cover 55, the cutting part of the fixed blade 51 is securely protected.

Furthermore, as the guide part 55*c* for guiding the carriage of recording paper 9 is integrated with the shielding part 55*b*, the guide part 55*c* can be precisely arranged for the shielding part 55*b*, and recording paper 9 can be securely guided to between the cutting parts 51*a* of the fixed blade 51 and the cutting parts 37*a* of the movable blade 37 along the guide part 55*c*.

In addition, the cutting part 51*a* of the fixed blade 51 can be more securely protected in cooperation with the shielding part 55*b* of the blade cover 55 by providing the guide part 70*a* of the paper guide 70.

As the guide part 55*c* is moved together with the fixed blade supporting frame 6 if the fixed blade supporting frame 6 is opened and the transport path P of recording paper 9 is free, work such as replacing rolled paper can be easily performed.

Of course, the present invention is not limited by the described embodiments. Any modification could be applicable within the scope of the subject matter.

The form of the blade cover 55 is not limited to that in the above embodiments. The form can be suitably varied and may be also integrally formed by resin and other material.

A compression coil has been described as the elastic structure 54 used to press the fixed blade 51 on the supporting structure of the fixed blade supporting frame 6. In another embodiment, a helical tension spring and other types of springs may be used.

The fixed blade 51 is provided on the side of the frame 6 which can be opened or closed, and the movable blade 37 is provided on the side of the body frame 2. The movable blade 37 may be also provided on the side of the frame which can be opened or closed and the fixed blade 51 may be also provided on the side of the body frame 2. However, to simplify the configuration, it is desirable that the cutting apparatus comprises the configuration as in the above embodiments.

The present invention can be applied to not only a thermal printer but also to other printers such as an impact dot printer and an ink-jet printer.

The cutting part of the cutter blade can be securely protected with a simple configuration by providing a protruded member for covering a part or the whole of the cutting part of the cutter blade if the frame is opened in the configuration provided with the cutter blade on the frame which can be opened or closed.

Other embodiments are in the scope of the following claims.

What is claimed is:

1. A cutting apparatus for cutting recording paper in a transport path, the cutting apparatus comprising:

a first cutter blade and a second cutter blade disposed in facing relation on opposite sides of the transport path;

first supporting structure that supports the first cutter blade;

second supporting structure that supports the second cutter blade, the second supporting structure being movable relative to the first supporting structure; and a blade shielding projection fixed relative to the second supporting structure and adjacent the second cutter blade, wherein the second cutter blade is movable relative to the second supporting structure between a shielded position in which the second cutter blade is at least partially shielded by the blade shielding projection and a cutting position in which the second cutter blade is not shielded by the blade shielding projection in accordance with a position of the second supporting structure relative to the first supporting structure.

2. A cutting apparatus according to claim 1, wherein the blade shielding projection is secured to the second supporting structure between the second cutter blade and the second supporting structure.

3. A cutting apparatus according to claim 1, further comprising an elastic body engaging the second cutter blade, the elastic body urging the second cutter blade toward the shielded position.

4. A cutting apparatus according to claim 3, wherein the second supporting structure is movable relative to the first supporting structure between an open position and a closed position, and wherein the first supporting structure comprises a touching part that engages the second cutter blade in the closed position, the touching part deflecting the second cutter blade toward the cutting position against an elastic force of the elastic body.

5. A cutting apparatus according to claim 1, further comprising a guide part that guides a carriage of the recording paper, the guide part being integrated with the blade shielding projection.

6. A cutting apparatus according to claim 1, further comprising a positioning support secured to the second supporting structure, the positioning support pivotally supporting an end of the second cutter blade opposite from a cutting end of the second cutter blade.

7. A cutting apparatus according to claim 1, wherein the first cutter blade is a movable blade, and wherein the second cutter blade is a fixed blade.

8. A cutting apparatus according to claim 7, wherein the first cutter blade is movably supported via the first supporting structure for crossing the second cutter blade in a scissors action or for sliding relative to the second cutter blade.

9. A cutting apparatus according to claim 1, further comprising a guide part secured to the second supporting structure, the guide part being positioned adjacent the transport path to guide the recording paper, the guide part cooperating with the blade shielding projection to protect the second cutter blade.

10. A printer comprising:

a main frame including a print unit for printing on recording paper;

a cover frame supported by the main frame and including a cover that is pivotable between an opened position and a closed position; and a cutting apparatus for cutting the recording paper in a transport path, the cutting apparatus comprising:

a first cutter blade and a second cutter blade disposed in facing relation on opposite sides of the transport path, the main frame supporting the first cutter blade, and the cover frame supporting the second cutter blade, and a blade shielding projection fixed relative to the cover frame and adjacent the second cutter blade, wherein the second cutter blade is movable relative to the cover frame between a shielded position in which the second cutter blade is at least partially shielded by the blade shielding projection and a cutting position in which the second cutter blade is not shielded by the blade shielding projection depending on whether the cover frame is in the opened position or the closed position.

11. A printer according to claim 10, wherein the blade shielding projection is secured to the cover frame between the second cutter blade and the cover frame.

12. A printer according to claim 10, further comprising an elastic body engaging the second cutter blade, the elastic body urging the second cutter blade toward the shielded position.

13. A printer according to claim 12, wherein the main frame comprises a touching part that engages the second cutter blade in the closed position, the touching part deflecting the second cutter blade toward the cutting position against an elastic force of the elastic body.

14. A printer according to claim 10, further comprising a guide part that guides a carriage of the recording paper, the guide part being integrated with the blade shielding projection.

15. A printer according to claim 10, further comprising a positioning support secured to the cover frame, the positioning support pivotally supporting an end of the second cutter blade opposite from a cutting end of the second cutter blade.

16. A printer according to claim 10, wherein the first cutter blade is a movable blade, and wherein the second cutter blade is a fixed blade.

17. A printer according to claim 16, wherein the first cutter blade is movably supported via the main frame for crossing the second cutter blade in a scissors action or for sliding relative to the second cutter blade.

18. A cutting apparatus for cutting paper in a transport path, the cutting apparatus comprising:

a first cutter blade and a second cutter blade disposed in facing relation on opposite sides of the transport path;

a first supporting structure that supports the first cutter blade;

a second supporting structure having a surface for supporting the second cutter blade and being movable relative to the first supporting structure, the second cutter blade being movable between a shielded position and a cutting position and moving away from the surface and into the cutting position in accordance with the relative movement of the second supporting structure toward the first supporting structure; and a projection for at least partially shielding the second cutter blade in the shielded position, the projection extending substantially parallel with a cutting part of the second cutter blade and substantially across a width of the second cutter blade, the projection protruding from the surface of the second supporting structure toward the second cutter blade, wherein the projection is fixed relative to the second supporting structure.

19. A printer comprising:

a main frame including a print unit for printing on recording paper;

a cover frame supported by the main frame and including a cover that is pivotable relative to the main frame between a blade shielding position and a cutting position; and a cutting apparatus for cutting the recording paper in a transport path, the cutting apparatus comprising:

a first cutter blade and a second cutter blade disposed in facing relation on opposite sides of the transport path, the main frame supporting the first cutter blade, and the cover frame having a surface supporting the second cutter blade, the second cutter blade moving away from the surface and into the cutting position in accordance with relative movement of the cover frame toward the main frame, and a projection for at least partially shielding the second cutter blade in the shielded position, the projection extending substantially parallel with a cutting part of the second cutter blade and substantially across a width of the second cutter blade, the projection protruding from the surface of the second supporting structure toward the second cutter blade, wherein the projection is fixed relative to the cover frame.

20. A printer comprising:

a main frame including a print unit for printing on recording paper;

a cover frame supported by the main frame and including a cover that is pivotable between an opened position and a closed position; and a cutting apparatus for cutting the recording paper in a transport path, the cutting apparatus comprising:

a first cutter blade and a second cutter blade disposed in facing relation on opposite sides of the transport path, first supporting structure that supports the first cutter blade, second supporting structure that supports the second cutter blade, the second supporting structure being movable relative to the first supporting structure, a blade shielding projection fixed relative to the second supporting structure and adjacent the second cutter blade, and a guide part secured to the second supporting structure, the guide part being positioned adjacent the transport path to guide the recording paper, the guide part cooperating with the blade shielding projection to protect the second cutter blade, wherein the second cutter blade is movable relative to the second supporting structure between a shielded position in which the second cutter blade is at least partially shielded by the blade shielding projection and a cutting position in which the second cutter blade is not shielded by the blade shielding projection in accordance with a position of the second supporting structure relative to the first supporting structure.

* * * * *